United States Patent [19]

Heineman, III

[11] 4,324,821

[45] Apr. 13, 1982

[54] ARTIFICIAL FLOWER AND METHOD FOR MAKING THE SAME

[76] Inventor: Samuel Heineman, III, 1400 Mill Creek Rd., Gladwyne, Pa. 19035

[21] Appl. No.: 221,518

[22] Filed: Dec. 30, 1980

[51] Int. Cl.[3] ..... A41G 1/00

[52] U.S. Cl. ..... 428/24; 156/61

[58] Field of Search ..... 428/24, 25, 26; 156/61; 362/122, 805

[56] References Cited

U.S. PATENT DOCUMENTS

| | | | |
|---|---|---|---|
| 1,879,677 | 9/1932 | Gockel | 428/26 |
| 2,075,327 | 3/1937 | Abrams et al. | 428/24 X |
| 3,634,678 | 1/1972 | Glass et al. | 428/26 X |
| 3,822,171 | 7/1974 | Bouillot | 428/25 |

FOREIGN PATENT DOCUMENTS

| | | | |
|---|---|---|---|
| 1188643 | 4/1970 | United Kingdom | 428/26 |

*Primary Examiner*—Henry F. Epstein

*Attorney, Agent, or Firm*—Daley & Brandt

[57] ABSTRACT

An artificial flower is made by receiving the wire filaments of a plurality of petals in the passages of an elongated receptacle thereby holding the petals and wire filaments in a predetermined array or "whorl" pattern, with a main stem wire also being received in the receptacle and the tip ends of the wire filaments which extend a distance below the receptacle being twisted in a convoluted course about the stem wire thereby to anchor securely the petal components to the main stem wire. Florist tape is wound in an overlaying course on the main stem wire, over the twisted tip ends of the wire filaments and onto the receptacle to further enhance the anchorage of the petal assembly and to impart a natural appearance to the flower structure.

12 Claims, 7 Drawing Figures

ARTIFICIAL FLOWER AND METHOD FOR MAKING THE SAME

BACKGROUND OF THE INVENTION

Artificial flowers as heretofore made generally have been assembled by winding or twisting filament wires extending from and attached to flower petal members about a main stem wire or by winding together two or more of the petal filaments and then winding or otherwise attaching as, e.g., with tape the filaments to the main stem wire following which the wire filaments as wound upon the main stem wire are overlayed with a wrapping of florist tape, the florist tape being of a color to lend semblance of natural appearance to the stem and also functioning to further secure the petal assembly to the main stem wire.

Such method is not completely satisfactory inasmuch as following the assembly of flowers at a factory and shipment of same to an ultimate user, petals frequently are found to have become loosened and disassembled from the main stem wire. This occurs principally because notwithstanding that the wire filaments of the petals have been wound to the main stem wire, handling of the assembled flower in shipping results in some of the petal wire filaments pulling loose from the assembly. This thus requires that the ultimate user attempt to reinsert the petal wire filaments into the flower cluster of petals or alternatively remove the tape and reassemble the entire flower structure. It is clear that such disadvantageous result could be eliminated if a simple yet foolproof manner of anchoring the petal wire filaments to the main stem wire were provided.

SUMMARY OF THE PRESENT INVENTION

The present invention relates to an artificial flower and a method for making artificial flowers. The flower and the method by which it is made is characterized by the convenience and facility with which the plural petals forming a "whorl" can be held and permanently secured to a stem piece. Moreover, the integrity of the assembled flower structure is maintained completely from the time of manufacture through ultimate display use and nothing short of deliberate action can result in damage to the flower.

In accordance with the invention, the wire filaments which form the stem part of the petal component of a flower and which are generally adhered to the petal backs are received in an elongated receptacle having a plurality of through passages, with the wire filaments being received in the passages in such manner that a tip end portion of the wire filaments extend a distance beyond the receptacle remote from their associated petals. Since the passages in the receptacle are disposed in a predetermined array, there consequently results the holding of the petal filament wires and associated petals in a corresponding order of array in the "whorl" or semblance of a natural flower. A main stem wire is also received in and extends through a passage in the receptacle and the tip ends of the wire filaments are twisted in a convoluted course about the stem wire. By thus twisting the filament wires and since the twisting is effected from laterally outwardly spaced locations relative of the stem wire, there results an anchoring of the filament wires and their associated petals in an optimized secure manner which prevents accidental or even deliberate withdrawal of the petals and filament wires from the assembly. A winding of florist tape extends along the main stem wire onto and around the twisted wire filaments and continues in winding embrace about the receptacle, desirably being terminated in its winding course in the region where the wire filaments merge onto the petals themselves.

In accordance with the invention, the elongated receptacle can be of generally cylindrical shape or it may be of tapered cylindrical shape, with the diameter of the cylinder diminishing in the direction away from the petals. The passages extending through the receptacle are generally disposed in a circular array relatively of the receptacle as viewed from an end thereof and additionally there may be a central passage which can serve to receive the main stem wire with the wire filaments normally being received in the circular array of passages extending about the central passage. Where the receptacle is of tapered configuration, the passages extending therethrough are disposed in converging courses which follow the tapered configuration of the receptacle.

While the invention is described herein in terms of the reception of wire filaments of petals in the passages of the receptacle, it will be understood that the other components of a flower as for example a pistil also can be received centrally of the arrayed petals and within the receptacle inasmuch as such pistil component forms part of a flower and its presence is desirable if a high degree of realism in the appearance of the flower is to be attained.

The petal members generally are provided in the form of a shaped and colored fabric to which is adhesively secured a wire filament, the wire filament in turn being coated or covered with a material covering to closely simulate the appearance and texture of natural flower structures.

BRIEF DESCRIPTION OF THE DRAWINGS

The invention will appear more clearly from the following detailed description taken in conjunction with the accompanying drawings in which.

Throughout the following description, like reference numerals are used to denote like parts in the drawings.

DESCRIPTION OF THE PREFERRED EMBODIMENTS

Figure 1:
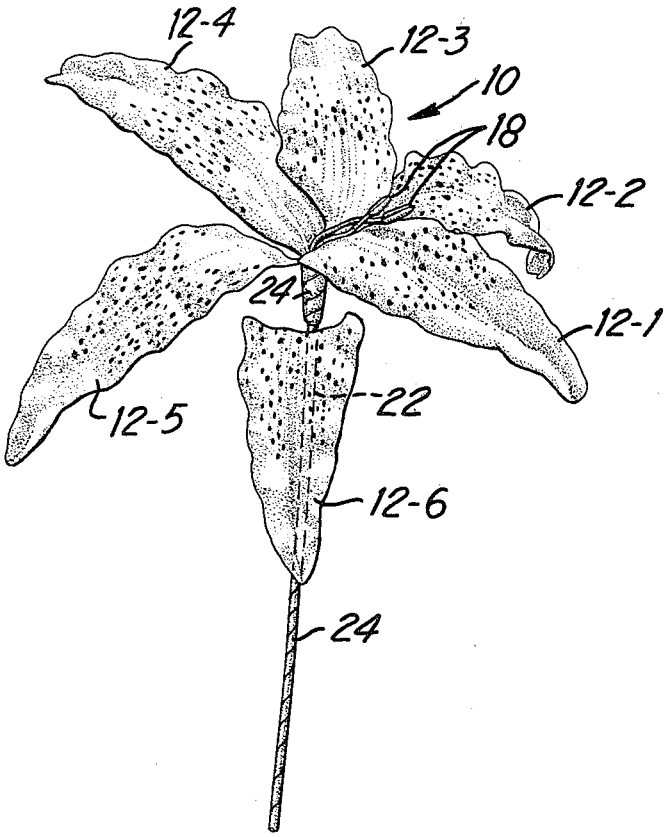
FIG. 1 is a perspective view of an artificial flower made in accordance with the principles of the present invention, a portion of one of the petals of the flower being removed for purposes of clarity of depiction of the positioning of the receptacle in the assembled flower.
Figure 7:
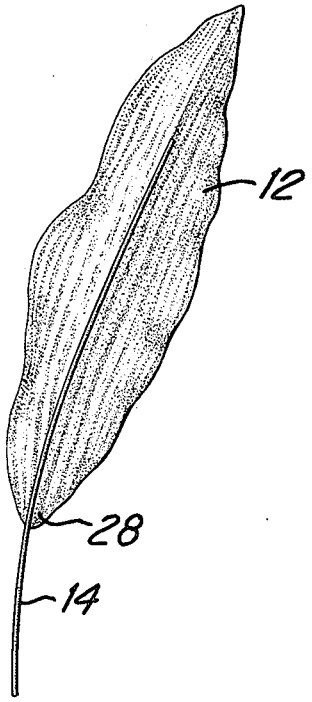
FIG. 7 is an elevational view of a petal with attached wire filament.

Referring to FIG. 1 of the drawings, the flower 10 depicted is illustrated by way of example only as being a lily, it being understood that the invention has applicability to the making of a wide range of flower forms. Further it will be understood that the leaves which are found in natural flowers and are attached to the main stem are not depicted but it will be understood would be formed in known manner as part of the finished artificial flower. A representative artificial lily petal 12 is shown in FIG. 7 and has as part thereof a stem or wire filament 14 which is fixed to the petal preferably in adhesive connection therewith, the wire filament having an appreciable length for purposes as will be understood upon further reading of the specification and such wire filament being covered along its length in a fabric sleeve of suitable color affecting a natural stem. The petal itself is also formed of a fabric or other suitable material and is colored or multicolored, spotted and otherwise provided with appearance and shaping after the natural flower petal it is intended to simulate.

Figure 2:
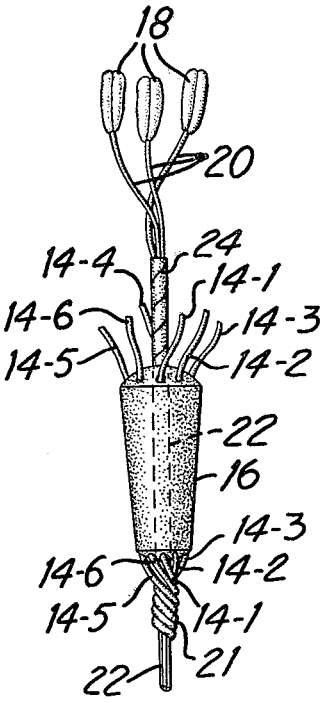
FIG. 2 is a fragmentary elevational view on enlarged scale of a segment of the flower shown in FIG. 1, petals not being shown and the florist tape overwrap being removed for purposes of clarity, the view illustrating the manner in which the petal wire filaments are received in the receptacle and the tip ends of the filaments wound on the stem wire.

With reference again to FIG. 1, flower 10 has six petals 12-1, 12-2, 12-3, 12-4, 12-5 and 12-6 each with its respective wire filaments 14-1, 14-2, 14-3, 14-4, 14-5 and 14-6, the wire filaments being received in and held in spaced ordered array in an elongated receptacle 16 (at best seen in FIG. 2). Also forming part of flower 10 and centrally disposed of the petals are a number of pistils 18, the pistils also having wire filaments 20 which can be received in the receptacle. A main stem wire 22 extends up into and optimally may extend a distance above the receptacle in which instance, the pistils 18 could be secured to the extension length of the stem wire. As will be noted in FIG. 2, the wire filaments 14 are received in receptacle 16 in such manner that tip ends of the filaments, i.e., the ends remote from the petals extend down below the receptacle for a distance and such tip ends are twisted in a convoluted course 21 about the stem wire. Since the receptacle is provided with a plurality of passages receiving the wire filaments as will be discussed in more detail below, and since such passages are generally disposed laterally outwardly of the floral axis, that is, of the stem wire 22 there results when the tip ends are twisted, an offset in their twisted portions relative to the remainder upper lengths of the wire filaments which forms with the receptacle an anchorage rendering it very difficult if not impossible to remove any petal and wire filament except by deliberate action which would be destructive to the flower. As seen in FIG. 1 tape, e.g., conventional green florist tape 24 is wound along the stem wire, around the wire filament twist and onto the receptacle. Moreover, the tape winding can continue upwardly and embrace the lower portion of the petals as, for example, at 28 (FIG. 7) to prevent the petal from being pulled off its associated wire filament.

Figure 3:
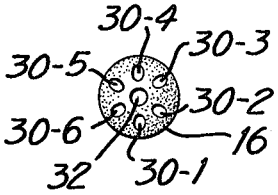
FIG. 3 is a top end view of the form of receptacle used in the FIGS. 1 and 2 construction for reception of the petal wire filaments.
Figure 4:
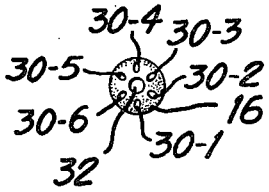
FIG. 4 is an end view of the receptacle shown in FIG. 3 as viewed from the other or bottom end thereof.
Figure 5:
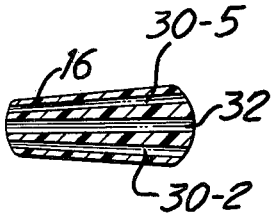
FIG. 5 is a longitudinal sectional view on enlarged scale of the receptacle shown in FIGS. 3 and 4 depicting in greater detail the through passage construction thereof.

FIGS. 3–5 show further details of the construction of the receptacle 16. The receptacle 16 is an elongated generally tapered cylindrical body having a plurality of passages extending therethrough from the upper to the lower ends thereof. The passages include, e.g., six (6) passages 30-1, 30-2, 30-3, 30-4, 30-5 and 30-6 arranged, as seen from the ends of the receptacle in a circularly spaced array. Although it is preferable, it is not essential that the respective petal wire filaments be received in passages 30 inasmuch as some of the petal wire filaments 14 could be received in central passage 32 depending on the type of flower being made and the effect to be created. Similarly and while the central passage 32 is primarily intended for reception of the stem wire 22, such stem wire could be received in one of the passages 30.

A particular advantage of the receptacle 16 is that in shape and size and when fixed in place on the flower, it closely follows the appearance and size of the receptacle of a natural flower. In an actual embodiment, the receptacle 16 measures about $\frac{3}{8}$–$\frac{1}{2}$ inch in length and varies in diameter from about $\frac{1}{4}$ inch at the top to about 3/16 of an inch at the bottom. The receptacle readily can be molded of thermoplastic material. Where the receptacle is tapered as in the instance of the FIGS. 3–5 embodiment, the passages 30, 32 coverage from top to bottom of the receptacle in correspondence to the taper of the receptacle body.

Figure 6:
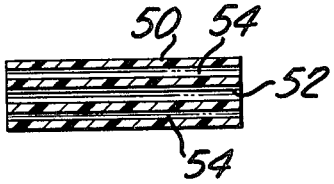
FIG. 6 is a longitudinal sectional view of a further form of receptacle.

The receptacle need not be of tapering cylindrical configuration but could be of the constant diameter cylinder configuration, depicted in FIG. 6. Thus receptacle 50 is of elongated uniform diameter and is provided with a central passage 52 and a plurality of circularly spaced passages 54. Other shapes could be employed for the receptacle such as square-section, rectangular section, etc.

While the description given before has pointed out that florist tape can be wound about the stem wire, receptacle and wire filament twists, it will be appreciated that other forms of covering could be used for such purpose. Thus, for example, a tubular member could be slid over the stem wire and upwardly snugly against the array of wire filaments as they enter the top of the receptacle. Such tube member could be made of fabric, plastic, etc. Other forms of coverings as, for example, paper winding also can be used which winding could be glued to the stem wire.

While there is disclosed above only certain embodiments of the present invention, it will be appreciated that it is possible to effect various modifications therein without departing from the scope of the inventive concept herein disclosed.

What is claimed is:

1. An artificial flower comprising a plurality of petals, each petal having a wire filament extending therefrom, an elongated receptacle having a plurality of through passages extending axially thereof, the wire filament of said petals being received in said passages and having tip ends extending a distance beyond said receptacle remote from their associated petals, at least some of the passages in said receptacle being disposed in predetermined circular array as viewed from an end of said receptacle to thereby hold the petal filament wires and their associated petals in corresponding order of array about a floral axis in the whorl semblance of a natural flower, and a main stem wire received in and extending through one receptacle passage, the tip ends of said wire filaments being twisted in a convoluted course about said stem wire, and said convoluted course which said wire filaments follow initiating at locations laterally offset relatively of the floral axis thereby to define when so twisted with the receptacle an anchorage for preventing withdrawal of said filament wires from the receptacle passages.

2. An artificial flower in accordance with claim 1 in which at least one of the passages in said plurality extends centrally of said receptacle.

3. An artificial flower in accordance with claim 1 in which said receptacle is of generally cylindrical configuration.

4. An artificial flower in accordance with claim 3 in which said receptacle is of tapered cylindrical configuration, the diameter thereof diminishing in a direction away from the petals.

5. An artificial flower in accordance with claim 3 in which the passages in said receptacle are disposed generally parallel one with the others.

6. An artificial flower in accordance with claim 4 in which the passages in said receptacle are disposed in converging courses following the tapered configuration of said receptacle.

7. An artificial flower in accordance with claim 2 in which said main stem wire is received in said central receptacle passage.

8. An artificial flower in accordance with claim 1 further comprising a tape winding overlaying the twisted tip ends of said wire filaments and extending in one direction for an appreciable distance in covering embrace about said main stem wire, said tape extending in an opposite direction in covering embrace about said receptacle.

9. An artificial flower in accordance with claim 8 in which said tape winding extends in said opposite direction a distance beyond said receptacle in tightly wound embrace about said filament wires and base portions of their associated petals.

10. An artificial flower in accordance with claim 1 further comprising a pistil member received in said receptacle and disposed generally centrally of the array of said petals.

11. A method for making an artificial flower which comprises receiving the wire filaments of a plurality of petals in an elongated receptacle having a plurality of through passages extending therethrough with the tip ends of the wire filaments extending a distance beyond the receptacle remote from the petals and spaced laterally outwardly of a floral axis defined by the central axis of the receptacle to thereby hold the petals in ordered array, receiving a main stem wire in one of the passages in said receptacle, and then twisting the tip ends of said wire filaments where they emerge from the respective receptacle passages inwardly relatively of the floral axis to form anchorages thereof against the adjacent end of the receptacle and in convoluted winding courses about said stem wire.

12. A method for making an artificial flower in accordance with claim 11 further comprising tightly winding a course of tape about said twisted tip ends and onto said main stem wire and at least a portion of the surface of said receptacle.

* * * * *